United States Patent [19]

Bullock

[11] 4,117,568

[45] Oct. 3, 1978

[54] CRANK HANDLE FOR WINDOW REGULATOR SHAFT

[75] Inventor: Paul Bullock, Grosse Pointe Woods, Mich.

[73] Assignee: Robin Products Company, Farmington Hills, Mich.

[21] Appl. No.: 757,541

[22] Filed: Jan. 7, 1977

[51] Int. Cl.[2] ..... G05G 1/10

[52] U.S. Cl. ..... 16/110 R; 74/543; 74/545

[58] Field of Search ..... 16/110 R; 74/543, 545; 63/1 R, 2, DIG. 3

[56] References Cited

U.S. PATENT DOCUMENTS

| | | | |
|---|---|---|---|
| 1,611,549 | 12/1926 | Moore | 16/110 R |
| 2,778,547 | 1/1957 | Atterby | 63/DIG. 3 |
| 3,198,032 | 8/1965 | Pollak | 74/545 |
| 3,222,951 | 12/1965 | Maursey | 74/543 |

FOREIGN PATENT DOCUMENTS

| | | | |
|---|---|---|---|
| 1,098,836 | 4/1955 | France | 63/DIG. 3 |
| 2,401,253 | 7/1975 | Fed. Rep. of Germany | 16/110 R |

*Primary Examiner*—Louis K. Rimrodt

*Attorney, Agent, or Firm*—Cullen, Sloman, Cantor, Grauer, Scott, & Rutherford

[57] ABSTRACT

A crank handle for a window regulator shaft has a unit body which includes an elongated shank, a head at one end of the shank on one side thereof having a fluted bore adapted to frictionally receive said shaft for securing thereto, and a knob element of generally spherical shape at the other end of said shank as an integral part thereof and extending laterally to the opposite side thereof. A hollow swivel knob of plastic material having a generally spherical-shaped bore open at one end to define a flexible annular lip is loosely assembled over and encloses the knob element, said knob element being rotatable relative to said knob. The annular lip is of such dimension and elasticity as to be force assembled over said knob element.

3 Claims, 7 Drawing Figures

FIG. 5
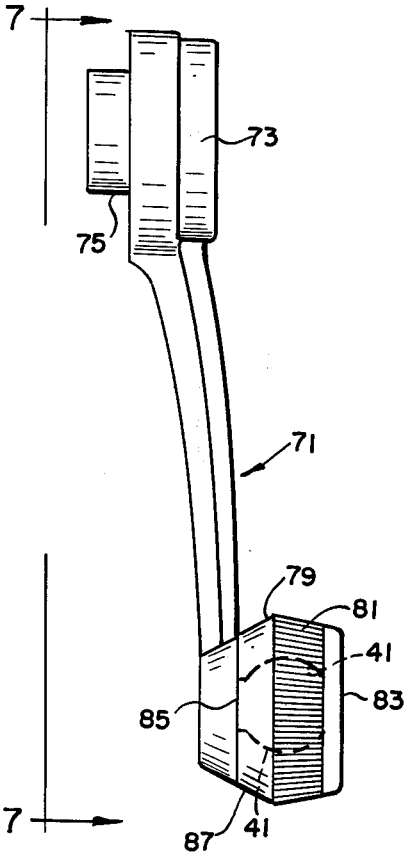
FIG. 6
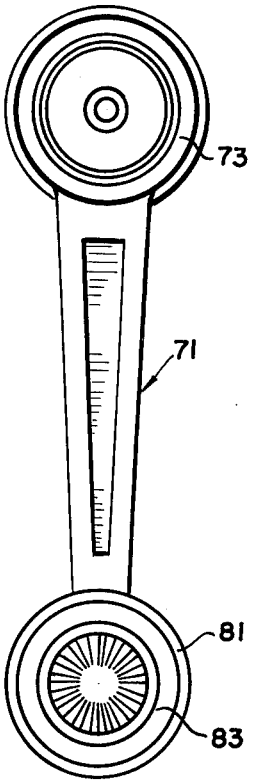
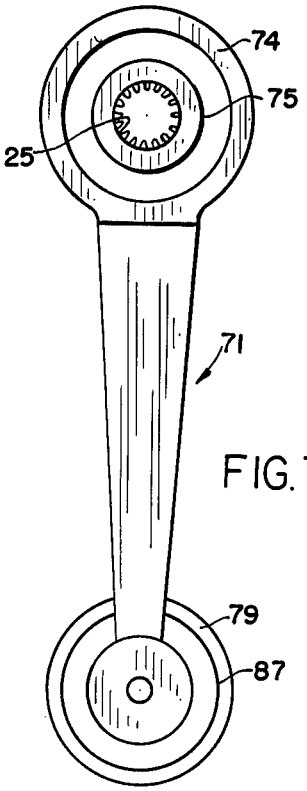
FIG. 7

CRANK HANDLE FOR WINDOW REGULATOR SHAFT

BACKGROUND OF THE DISCLOSURE

Heretofore, in the construction of crank handles for the window regulator shaft, particularly for vehicles, there has been the difficult problem of assembling the knob upon the free end of the crank handle. This has been accomplished by forming the crank handle at its free end with a boss of sufficient size and shape as to cooperatively receive a knob assembly which includes a rivet and suitable washers for assembly over the crank handle end and for securing thereto in such a manner as to permit the knob to be freely rotatable relative to the crank handle.

Various devices and rivet assemblies have been employed of a very involved nature by which the preselected knob is mounted and secured upon the free end of the crank handle in such a manner as to be swivelly mounted thereon. Often the knob becomes loose and wobbles, or comes off completely.

Heretofore, in the manufacture of crank handles of this type, the head portion of the crank handle, where it is apertured to receive the window regulator shaft, is often of metal requiring the interposing between the head and the conventional wall panel of a vehicle of a suitable friction-minimizing washer.

SUMMARY OF THE INVENTION

The present crank handle for a window regulator shaft comprises a unit body including an elongated shank, a head at one end of and a part of the shank, having a transverse irregularly shaped bore adapted to frictionally receive said shaft for securing thereto, and a knob element of generally spherical shape at the other end of said shank as an integral part thereof.

A hollow swivel knob of plastic material having a generally spherical shaped bore is open at one end defining a flexible annular lip and is loosely assembled over and encloses said knob element. There is thus provided a two piece crank handle assembly having an integral shank and ball shaped fastener, over which the hollow swivel knob is snapped.

There is provided a safety feature in that in the event of sudden impact, the crank handle will not fracture and injure the passenger, there is no rivet to injure the passenger, and if the swivel knob is broken off, the crank handle can still be operated by its spherical knob element.

A further advantage resides in eliminating the use of rivets for securing the swivel knob upon the crank handle, with a consequent reduction in assembly time and cost.

THE DRAWINGS

FIG. 5 is a side elevational view of a modified crank handle.

FIG. 6 is an end elevational view thereof.

FIG. 7 is a similar view taken in the direction of arrows 7—7 of FIG. 5.

It will be understood that the above drawings illustrate merely a preferred embodiment of the invention, and that other embodiments are contemplated within the scope of the claims hereafter set forth.

DETAILED DESCRIPTION OF THE INVENTION

Figure 1:
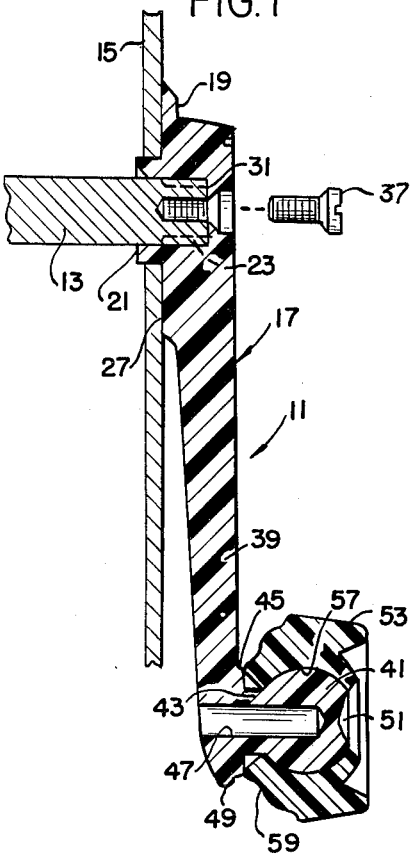
FIG. 1 is a vertical section of the present crank handle as mounted upon a window regulator shaft projecting through a wall panel, fragmentarily shown.
Figure 2:
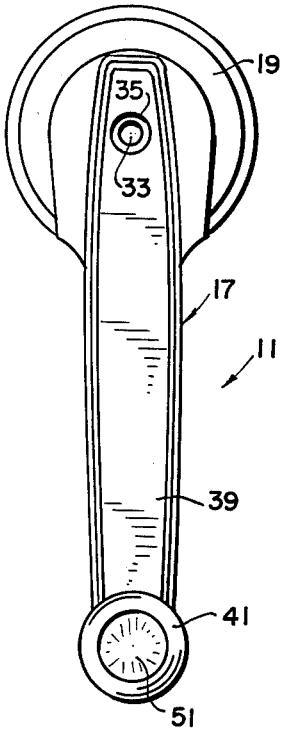
FIG. 2 is an end elevational view of the present crank handle, on an increased scale.

Referring to the drawing, a crank handle, generally indicated at 11, FIGS. 1 through 4, is adapted to receive and be secured to the window regulator shaft 13, fragmentarily shown in FIG. 1, forming a part of a conventional window regulator within the wall panel 15, fragmentarily shown, of a vehicle such as a vehicle door or body.

Said crank handle has a unit body 17 of plastic material, or of die cast material and includes an elongated formed shank 39. The head 19, extending from one side of the shank at one end thereof, includes the laterally extending sleeve 21 which is adapted to project through a corresponding aperture surrounding regulator shaft 13 within wall panel 15.

Figure 4:
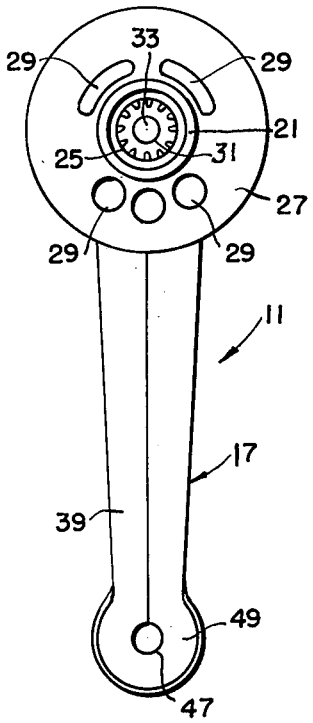
FIG. 4 is a rear elevational view taken in the direction of arrows 4—4 of FIG. 3.

Formed within the head 19 and coaxial of sleeve 21 is an irregularly shaped bore 23 which may be square or otherwise formed or fluted such as shown at 25, FIG. 4, adapted to snugly and tightly and frictionally engage an end portion of the window regulator shaft 13.

Head 19 has a flat end face 27 defining a bearing surface adapted for cooperative sliding registry against the wall panel 15. Said bearing surface lies in a plane substantially at right angles to the axis of the sleeve 21. Portions of the bearing surface have formed therein a series of cut-away slots 29 which cut down on the weight of the complete crank handle and at the same time, reduce the total amount of surface engagement of said bearing surface with respect to the wall panel.

The bore 23 at its inner end terminates in seat 31 which is centrally apertured at 33. Said seat serves as a stop for the regulator shaft 13 upon one side thereof and is adapted to receive the headed screw 37 upon the other side thereof which extends into counterbore 35, through aperture 33 and into a corresponding threaded aperture within said regulator shaft.

Upon the other end of shank 39 and projecting laterally thereof upon the side of said shank opposite from bearing surface 27 is a cylindrical neck 43 of uniform diameter which terminates in the generally spherically-shaped knob element 41 as an integral part of said body.

Said neck at its inner end adjacent said shank terminates in the annular boss 45 of increased diameter. Transverse bore 47 is formed through an end portion of shank 39 through said neck and substantially into knob element 41. The opposite side of the shank includes a rounded-end portion 49, FIG. 4. The outer end of the knob element 41 has an end face 51 which, in the illustrative embodiment, is concave as shown in FIG. 1.

The foregoing description is directed to the crank handle 11 of a unit body construction which includes as integral elements thereof the elongated shank 39, laterally directed head 19 at one end thereof, and the integral knob element 41 projecting from the opposite end of said shank outwardly thereof.

This assembly of the unit crank handle, preferably made of plastic or die cast material, would be sufficient in many instances to serve as a crank handle for the conventional window regulator shaft 13, fragmentarily shown in FIG. 1.

The present instruction is improved by the application to the knob element, of the swivel knob 53 of plastic material which is mounted over and encloses a substantial portion of the knob element.

Figure 3:
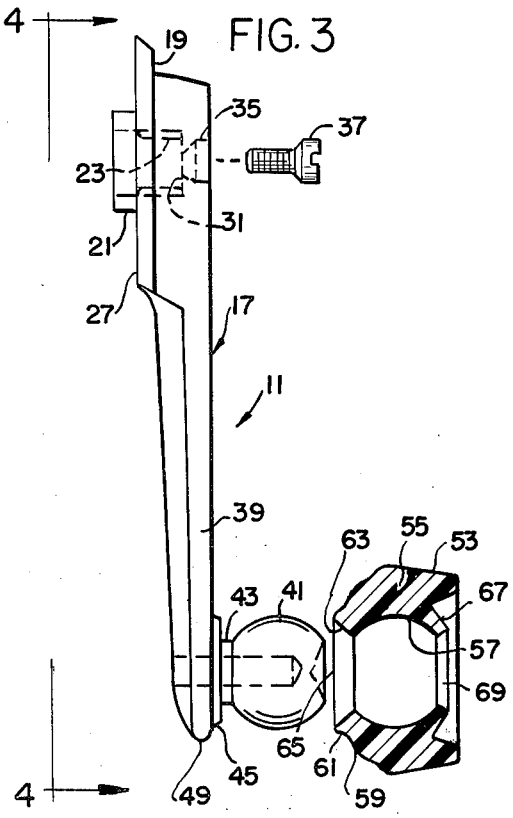
FIG. 3 is a left side elevational view thereof with the fastener as well as the swivel knob shown in exploded relation.

The present swivel knob shown in further detail in FIG. 3 is of a transparent or translucent plastic material and may be in different colors as desired. Said swivel knob includes a formed body 55 having a socket of general spherical shape and open at least at one end defining the annular flexible portion 59 terminating in the annular lip 61. Said lip is tapered outwardly as at 63, defining aperture 65 to facilitate forceful assembly of said knob over the knob element.

In other words, the aperture 65 at one end of the knob is of such dimension with respect to the maximum dimension of the knob element 41, and of such elasticity or flexibility that it is capable, upon the application of a suitable force such as between 200–500 pounds using a punch press or other tool, so as to expand and snap over and to retainingly engage knob element 41.

As assembled and as shown in FIG. 1, the annular lip 61 registers with and engages the cylindrical neck portion 43 between knob element and boss 45. This prevents wobbling of the knob and constrains relative rotation to a vertical plane.

The knob 53 may be closed as shown in FIG. 5. However, as shown in FIG. 3, the spherically-shaped socket is apertured at its end at 69 to define the annular stop flange 67 which cooperatively registers with corresponding surface portions of the knob element 41.

The unit body 17 for the crank handle may be made of various plastic materials, as for example, glass-filled Nylon and may be in different colors as desired. One such product is identified as duPont 70G-33L. Another suitable plastic material is Acetal, one product being identified as duPont Delrin 500. A mineral filled Nylon, such as the product manufactured by Monsanto and identified as Vydyne, would also be suitable for the crank handle body.

The swivel knob 53 is also constructed of a plastic material, preferably with a high degree of resiliency and of a different plastic material than the material which makes up the body of the crank handle. Illustrations of such material are duPont Surlyn 1554 and Surlyn 1559.

By making the knob 53 of one plastic material, and the body 17 of a different plastic material, improved lubication characteristics are incorporated between the engaging surfaces of the knob element and knob. Said knob is loosely disposed over the knob element and the knob element is adapted for rotation with respect to the normally stationary hand-held knob 53.

The plastic materials used are lubricious and additionally, are resistant to hydro-carbons.

Making the crank handle assembly as a unit plastic body provides a product for increased safety and with less chance of injury to a vehicle occupant under collision conditions.

The knob element 41 has been shown as being of generally spherical shape. It is contemplated that the ball element essentially is an integral part of the shank of the crank handle and, at least, will have thereon exterior rounded surfaces for cooperative registry with a corresponding knob formed with a socket of similar shape to enclose and loosely engage the knob element.

It is the force assembly of the knob 53 over and with respect to the knob element 41, such as shown in FIG. 3, which provides a completed construction. The knob as assembled over the knob element is not removable therefrom, but which eliminates the costly and involved mounting of swivel knobs using rivets and the like as has heretofore been the practice.

The plastic material incorporated into the knob has sufficient memory built into its flexibility and elasticity such that it will return to the normal form shown in FIG. 3 once assembled over the knob element such as shown in FIG. 1.

MODIFICATION

A modified crank handle is generally designated at 71 in FIGS. 5, 6 and 7. Here the elongated shank is similar to the shank 39 and terminates in the enlarged head 73 of circular form. As best shown in FIG. 7, the head upon one side has an annular rim 74 which provides a bearing surface for cooperative registry with a wall panel such as the wall panel 15, shown in FIG. 1.

Sleeve 75 is formed as an integral part of the head and is spaced concentrically inward of rim 74. Said sleeve has an axial bore which is fluted as at 25 or is, otherwise, irregularly shaped in order to frictionally receive the projecting end of the regulator shaft 13 as shown in FIG. 1.

The other end of the unit body for crank handle 71 terminates in the laterally extending knob of element 41, FIG. 5, overwhich has been snapped and positioned the plastic swivel knob 79. Said knob has a series of serrations 81 in its outer surface to facilitate operation and includes an end face 83 which closes the generally spherically-shaped bore within knob 79. Similarly, one end of the knob is apertured at 85 to define the annular lip 87. Said lip is of such dimension and elasticity as to be capable of snap and forceful assembly over the knob element in the same manner as heretofore described with respect to FIG. 3.

By the use of plastic materials in forming the unit body for the crank handle, it is no longer necessary to employ washers between the head of the crank handle and the adjacent wall panel 15, which is often used particularly where the crank handle is formed of metal.

Having described my invention, reference should now be had to the following claims.

I claim:

1. A crank handle for a window regulator shaft comprising a unit body of a plastic material including an elongated shank;

a head at one end of the shank on one side thereof having a transverse irregularly shaped bore adapted to frictionally receive said shaft for securing thereto;

a knob element of generally spherical shape at the other end of said shank as an integral part thereof and extending laterally to the opposite side thereof;

a hollow swivel knob of different plastic material having a spherically shaped bore, open at one end defining a flexible annular lip, loosely assembled over and enclosing said knob element, said knob element being rotatable relative to said knob;

said annular lip being out-turned, of conical shape and of such dimension relative to said knob element and of such elasticity as to be force assembled over said knob element and interlocked therewith;

said head having a flat end face at right angles to said bore defining a bearing surface;

and a sleeve receiving said shaft projecting laterally from said end face coaxial of said bore and adapted for extension through a wall panel, said bearing surface adapted to cooperatively engage said wall panel;

and a neck of uniform diameter between said shank other end and knob element, spacing said knob element outwardly of said shank and cooperatively receiving the annular lip of said swivel knob, said different plastic materials providing lubrication between said knob element and swivel knob reducing friction there between.

2. A crank handle for a window regulator shaft comprising a unit body including an elongated shank;

a head at one end of the shank on one side thereof having a transverse irregularly shaped bore adapted to frictionally receive said shaft for securing thereto;

a knob element of generally spherical shape at the other end of said shank as an integral part thereof and extending laterally to the opposite side thereof;

a hollow swivel knob of plastic material having a spherically shaped bore, open at one end defining a flexible annular lip having an opening smaller than said knob element, loosely assembled over and enclosing said knob element, said knob element being rotatable relative to said knob;

said annular lip being out-turned, of conical shape and of such dimension relative to said knob element and of such elasticity as to be force assembled over said knob element and interlocked therewith;

and a neck of uniform diameter between said shank other end and knob element, spacing said knob element outwardly of said shank and cooperatively receiving the annular lip of said swivel knob.

3. A crank handle for a window regulator shaft comprising a unit body including an elongated shank;

a head at one end of the shank on one side thereof having a transverse irregularly shaped bore adapted to frictionally receive said shaft for securing thereto;

a knob element of generally spherical shape at the other end of said shank as an integral part thereof and extending laterally to the opposite side thereof;

a hollow swivel knob of plastic material having a generally spherical shaped bore, open at one end defining a flexible annular lip, having an opening smaller than said knob element, loosely assembled over and enclosing said knob element, said knob element being rotatable relative to said knob;

and a neck of uniform diameter between said shank other end and knob element, spacing said knob element outwardly of said shank and cooperatively receiving the annular lip of said swivel knob.

* * * * *